United States Patent [19]

Vonhoff, Jr.

[11] Patent Number: 4,483,402

[45] Date of Patent: Nov. 20, 1984

[54] PAVING BREAKER

[75] Inventor: William Vonhoff, Jr., Montgomery, Ill.

[73] Assignee: Thor Power Tool Company, Aurora, Ill.

[21] Appl. No.: 326,239

[22] Filed: Dec. 1, 1981

[51] Int. Cl.[3] ..... B25B 45/16

[52] U.S. Cl. ..... 173/134; 173/112; 173/125; 91/317

[58] Field of Search ..... 173/134, 162, 125, 112; 251/324, 327; 137/102; 91/299, 325, 317

[56] References Cited

U.S. PATENT DOCUMENTS

| | | | |
|---|---|---|---|
| 2,100,541 | 11/1937 | Gartin | 91/299 |
| 3,045,768 | 7/1962 | Huffman | 91/325 |
| 3,084,673 | 4/1963 | Sears | 91/235 |
| 3,601,205 | 8/1971 | Kurt | 173/162 |
| 4,303,131 | 12/1981 | Clark | 173/134 |

*Primary Examiner*—E. R. Kazenske
*Assistant Examiner*—Willmon Fridie, Jr.
*Attorney, Agent, or Firm*—Augustus G. Douvas

[57] ABSTRACT

A paving breaker for the construction industry of the type having a vibrating moil point or tool steel impacted by a pneumatically reciprocated piston including a double walled cylinder slidably receiving the piston designed so that the space between the inner and outer walls of the cylinder forms a passageway for delivery of piston return air to the lower cylinder chamber and the space also forms an accumulator for air compressed by the piston during the lower part of its power stroke. In one embodiment an outer cylinder sleeve is mounted on an elastomeric member surrounding an inner cylinder sleeve, and is free to reciprocate a limited distance in the housing to partly balance the reaction forces of the piston. This double walled cylinder is surrounded by rectangular polyurethane covers that form an air exhaust space around the cylinder so that exhaust air assists in cooling the cylinder. Air is ported to the opposite ends of the cylinder by a self guiding valve member that has easily machined expansion grooves on opposite sides of a metering land and an annular guide stem that is slidably mounted in a bore in a lower valve block member mounted at the top or backhead of the paving breaker adjacent the cylinder, and this valve guide stem forms a conduit for air to the rear side of the piston.

8 Claims, 19 Drawing Figures

PAVING BREAKER

BACKGROUND OF THE PRESENT INVENTION

Paving breakers have been used in the construction industry for over a hundred years to repair and remove rigid aggregate materials such as rock, concrete, asphalt, etc. These tools employ a rapidly reciprocating tool, sometimes referred to in the industry as a moil point or steel having a chisel like end that impacts rapidly against and into the aggregate material in vibratory fashion. The moil point is usually reciprocated by a free piston slidable within a cylinder, driven by compressed air from a reversing valve, having a forward power stroke in which it impacts directly against the inner end of the moil point that projects within the cylinder. The steel is power driven only outwardly from the tool housing and either the reaction force from the work, or a retainer that engages a stop flange on the steel, returns the steel to its inner position projecting within the cylinder so that it may again be impacted by the piston during its next power stroke.

The reversing valve itself has taken several forms in the past such as an annular plate valve or a sleeve valve slidable on a valve guide stem, and these valves serve to direct compressed air to the opposite sides of the piston to cause piston reciprocation in the cylinder. These valves are shifted by differential pressure in the forward and rear cylinder chambers. The reversing valve does not usually control exhaust flow from the cylinder and this is frequently effected by an exhaust passage in the cylinder opened and closed by movement of the piston itself. When the reversing valve ports air to the backside of the cylinder during the power stroke, the piston travels forwardly (usually downwardly) in the cylinder driving air outwardly from the exhaust port in the cylinder until the piston covers the exhaust port and forward travel thereafter compresses air in the forward cylinder chamber as the steel end is approached. To prevent the compression of air in the forward cylinder chamber from unnecessarily decelerating the piston, return air passages communicating with this forward chamber frequently are formed by a plurality of large long bores in the tool housing that act as an accumulator for air being compressed in the forward chamber by the piston.

As the piston continues its forward stroke toward the steel end the rear end of the piston uncovers the exhaust port in the cylinder thereby exhausting the rear cylinder chamber reversing the differential pressure acting on the reversing valve and shifting the valve, terminating air flow to the rear cylinder chamber and porting air to the forward cylinder chamber through the return air passages. After the piston impacts against the steel end the increased pressure in forward chamber causes piston reversal into its return stroke. The piston exhaust port valving is the same in its return stroke causing differential pressure shifting of the reversing valve as the rear end of the piston uncovers the exhaust port.

Air flow to the reversing valve is conventionally controlled by a throttle lever controlled on/off valve in the tool housing adjacent tool handles. This rear housing area is conventionally referred to as a "backhead" and it usually includes two aligned outwardly extending handles—one of the handles has a throttle lever and is referred to as a "live" handle and the other handle is referred to as a "dead" handle. With this arrangement a worker can hold the tool handles with his right and left hands, operate the throttle lever and manipulate the tool without taking his hands off the handles.

Because of the high forces created in paving breaking tools of this type as a result of the impact of the piston directly against the steel end, it was heretofore believed necessary that the paving breaker housing be constructed of very heavy materials to absorb the high shock forces. Usually the housings are constructed of iron forgings and these are quite costly due to the heavy equipment required in their manufacture as well as the material cost itself. Moreover, the accumulator chambers, which form part of the return stroke air passages, must be drilled into the housing forging. Since these holes extend for a substantial distance down the length of the tool housing and since there are usually four to six such passages to provide the necessary accumulator volume, they represent a major cost factor in the manufacture of paving breaker tools.

Another problem in prior paving breakers utilizing heavy forged housing results from the thickness of the forging. Heat generation in the cylinder requires that some cooling passages be formed around the cylinder to maintain a sufficiently low operating temperature and this also adds significantly to the manufacturing cost of the tool.

The reversing valves for known paving breakers also have significant disadvantages. In the annular plate type reversing valve referred to briefly above, the plate has a relatively short axial length and is slidable in an annular chamber within mating valve block members. The outer peripheral surface of the plate controls air flow and thus requires a clearance between it and the valve block chamber for proper functional operation. However, this clearance permits the valve plate to tilt slightly as it reciprocates back and forth under differential pressure reversal imposed on it by cylinder chamber pressure. This tilting causes valve wear and contamination buildup, and eventually, if sufficient wear occurs, the valve may even lock in a canted position within the chamber rendering the tool inoperable.

Another type of known reversing valve refered to above is a sleeve type valve mounted and guided on a fixed guide post within a valve block. The valve sleeve has a long axial length to prevent valve tilting commonly associated with plate valves, and has a central outer land that meters flow with cooperating stationary annular surfaces in the associated valve block to both the forward and rear cylinder chambers as it reciprocates under differential pressure reversal. To promote the expansion of air as it passes over this metering land, two frusto-conical expansion surfaces are formed on the opposite sides thereof. Adjacent each of these metering lands are diametral, sealing surfaces that selectively engage annular sealing ribs formed within the valve block. While this prior valve has been found functionally satisfactory, it requires the accurate machining and grinding of at least nine surfaces, i.e. two annular metering surfaces and two sealing rib surfaces in the valve block, and one land, two frusto-conical expansion surfaces and two diametral sealing surfaces on the valve member. All these machining and grinding operations increase the resulting overall paving breaker cost.

A further problem in prior paving breakers results from the misalignment of the moil point with respect to the axis of the cylinder, as the steel itself is not precision mounted in the front end of the tool and in fact is rather loosely mounted so that misalignment between the tool steel and the cylinder axis frequently occurs. As the piston impacts against a misaligned tool it causes side reaction forces against the piston which tend to pivot the piston against the cylinder. Eventually this deleterious action causes unwanted cylinder wear.

SUMMARY OF THE PRESENT INVENTION

According to the present invention, a high strength, heavy duty paving breaker is provided without requiring the heretofore heavy forged housing, through the provision of a double walled cylinder mounted in a steel backhead at one end and a steel fronthead at the other end surrounded only by rigid impact resistant plastic covers.

The doubled walled cylinder defines a passageway between the cylinder walls that serves not only to convey return air from an improved self guiding reversing valve to the forward cylinder chamber but also acts as an accumulator for compressed air in the forward chambers during the piston power stroke. This arrangement totally eliminates the very expensive machining of the return passages in the steel or iron housings formerly thought required for paving breakers of this type.

In one embodiment of the present invention the annular space between outer and inner cylinder sleeves is partly filled (with the exception of the return passage) with an elastomeric material such as rubber or polyurethane, of proper durometer, and the outer sleeve is free to reciprocate a limited distance within the housing so that as the piston reciprocates in the inner sleeve the outer sleeve will reciprocate 180 degrees out of phase with respect to the piston to partly balance the reaction forces caused by piston reciprocation and thereby reduce tool vibration. This balancing is achieved by approximately equalizing the weight of the outer sleeve and the piston and by appropriately selecting the thickness and durometer of the elastomeric material between the sleeves.

A high density impact resistant plastic cover surrounds the cylinder assembly and is clamped between the steel back and front heads by tie rods extending axially through the tool. These cover members are preferably constructed of high density polyurethane and are of sufficient thickness so that even if run over by construction equipment are not significantly damaged. The covers are spaced from the cylinder assembly providing an open area along substantially the entire length of the cylinder so that exhaust air from the cylinder can freely pass along the outside thereof to assist in cooling the cylinder in an efficient manner without requiring the forming or machining of any special cooling passages along the cylinder walls.

An improved reversing valve is also provided according to the present invention that is self guiding to eliminate valve tilting, is sufficiently light to accommodate higher order dithering and at the same time requires less machining and grinding that prior known valves. Toward this end the valve includes an enlarged flange portion having a central outer land that controls flow to both the forward and rear chambers of the cylinder assembly. Expansion surfaces are provided on this enlarged flange by easily formed grooves adjacent the sides of the metering land that do not require any special machining or any special grinding eliminating the frusto-conical expansion surfaces on prior sleeve type valves that require grinding. The enlarged flange is formed intergrally with a small cylindrical guide portion that is slidably received in a bore in a lower valve block that serves not only to guide the enlarged section of the valve in precision linear reciprocating movement but also serves as the cylinder chamber inlet port for the rear cylinder chamber. This reversing valve eliminates the requirement for stationary guide posts in the valve block normally thought necessary for guiding sleeve type valves in tools of this type, while at the same time it is equally light in weight for rapid response.

A further feature of the present invention is the provision of a tappet or plunger mounted in the forward end of the cylinder and guided for pure reciprocating motion in spaced bores in a tappet seat closing the forward end of the cylinder. As the piston moves forwardly in its power stroke it impacts against an end of this tappet extending into the cylinder and the opposite end of the tappet has a head that impacts against the tool steel end. Any misalignment between the tool steel and the piston and cylinder assembly is harmlessly transmitted to the tappet rather than to the piston and cylinder. This reduces cylinder wear, piston wear and improves overall tool performance.

DETAILED DESCRIPTION OF THE PREFERRED EMBODIMENTS

Figure 1:
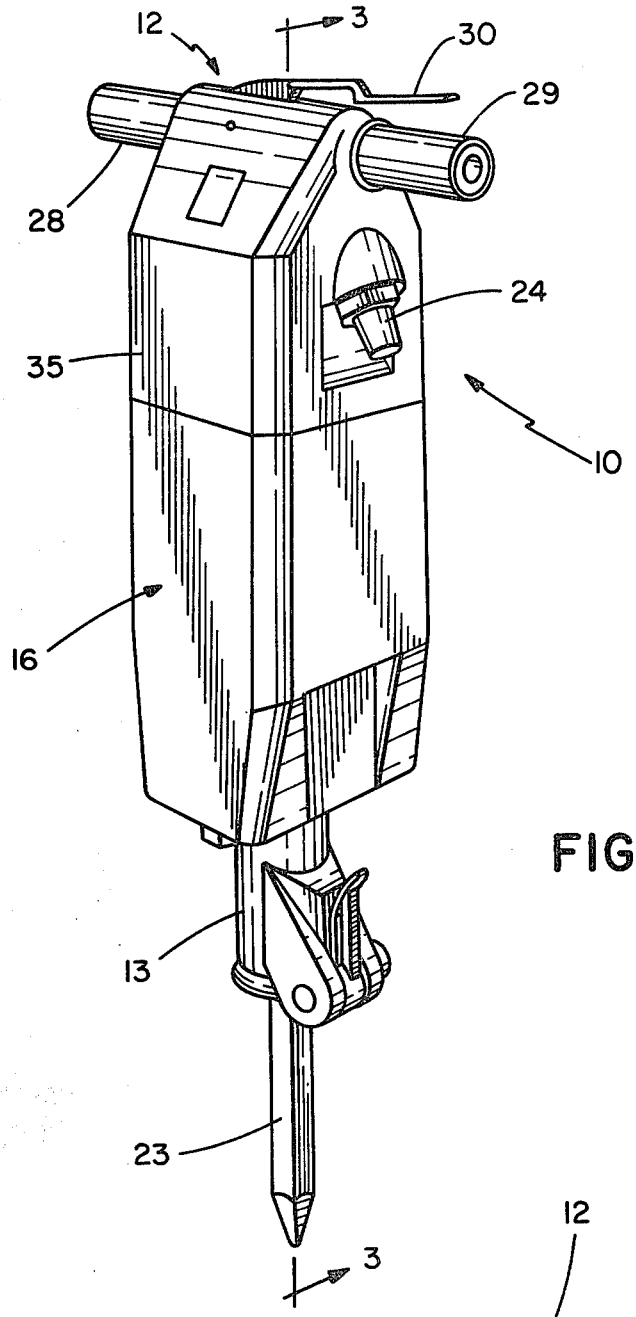
FIG. 1 is a perspective view of a paving breaker according to the present invention.
Figure 2:
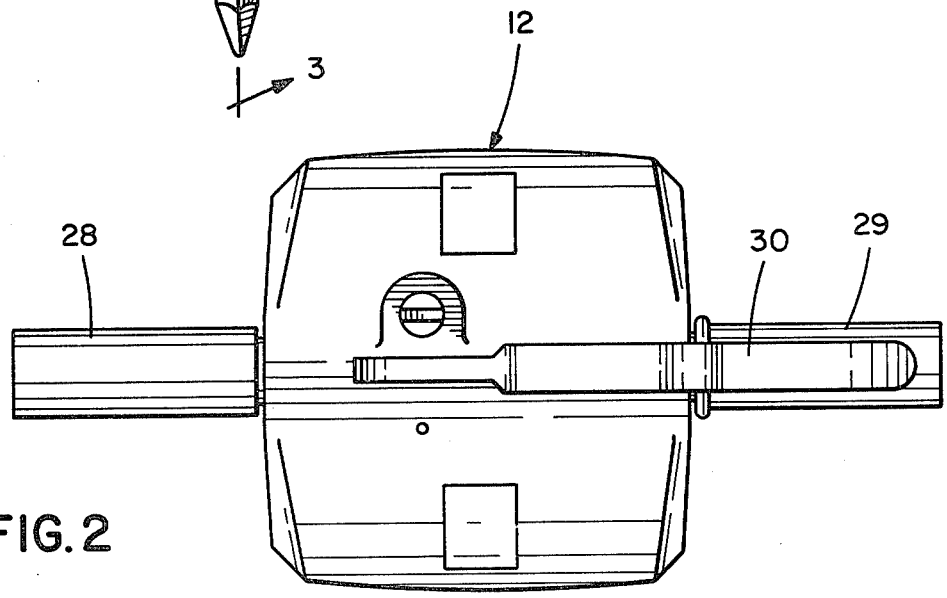
FIG. 2 is an enlarged top view of the paving breaker illustrated in FIG. 1 showing the throttle lever projecting to the right.
Figure 3:
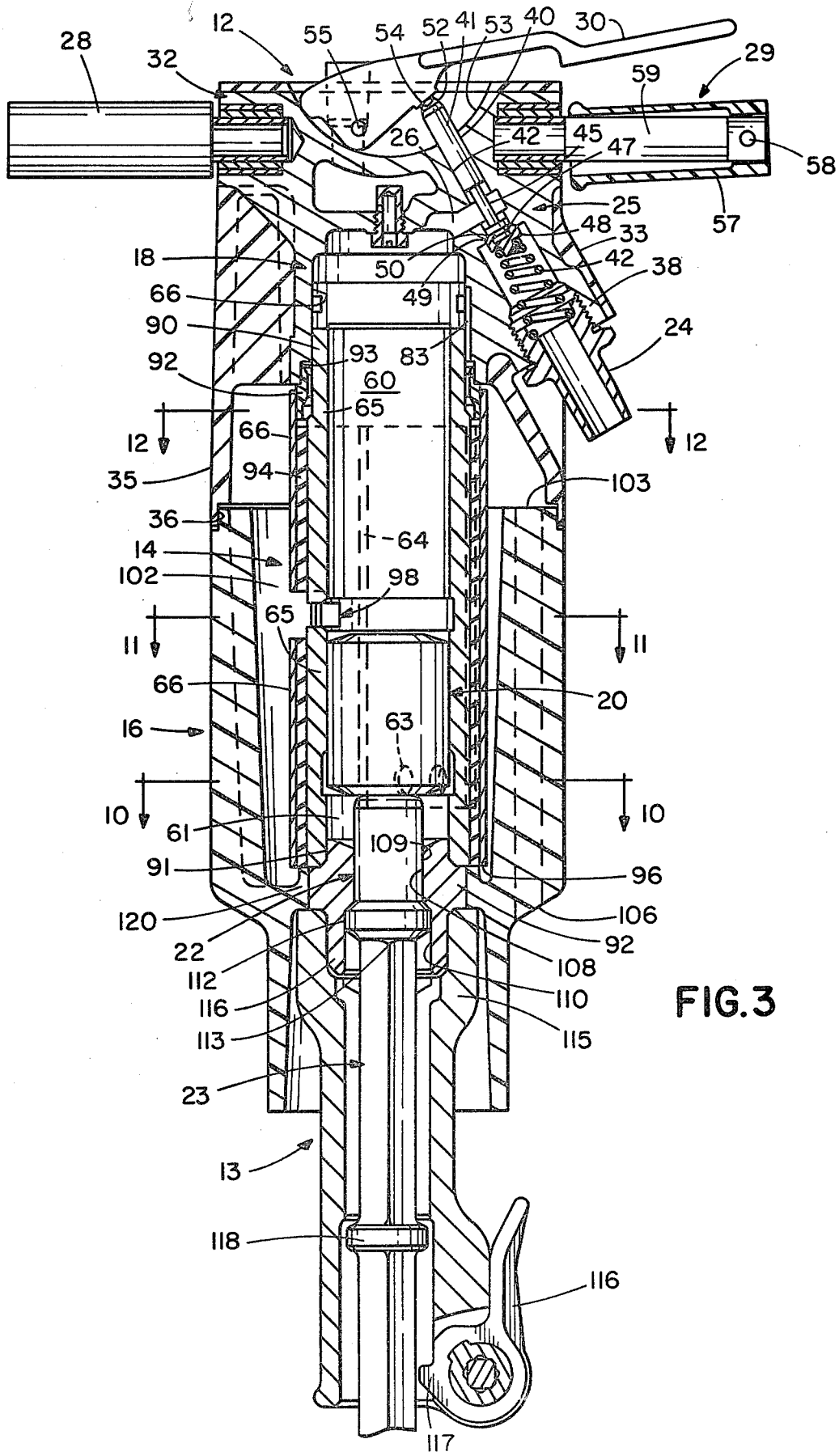
FIG. 3 is a longitudinal section of a paving breaker according to one embodiment of the present invention taken generally along line 3—3 of FIG. 1.
Figure 4:
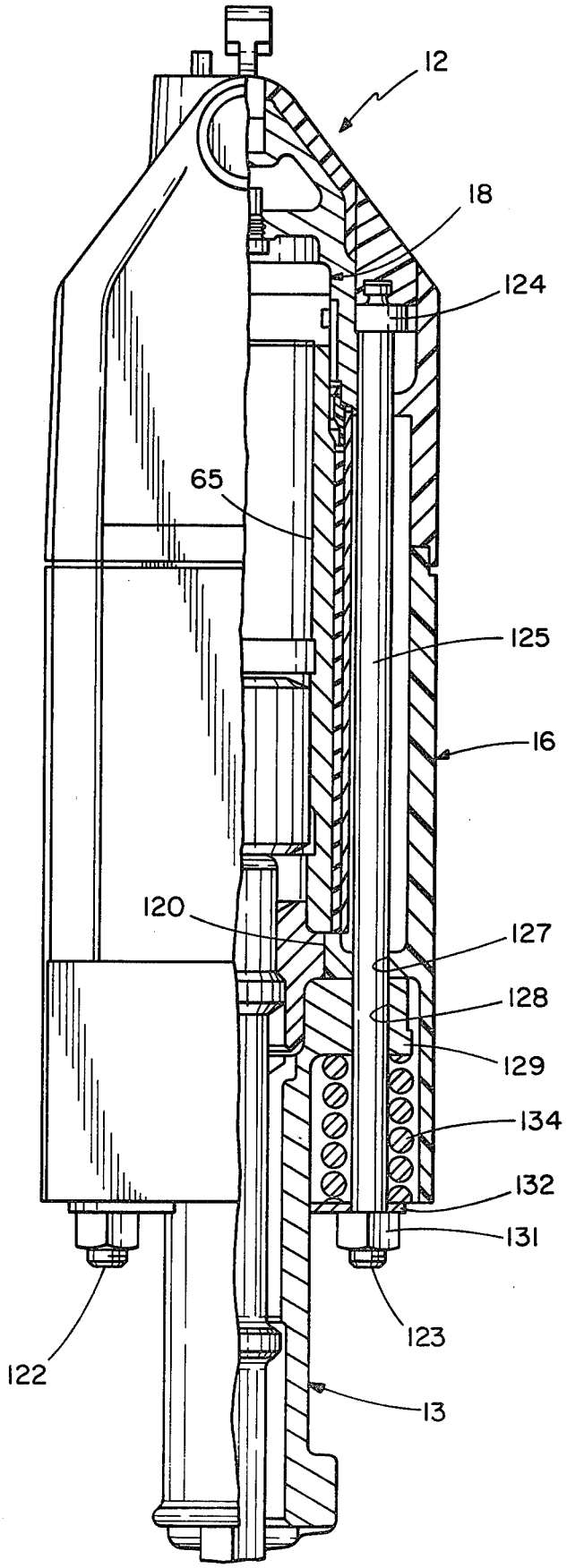
FIG. 4 is a fragmentary longitudinal section of a paving breaker according to the present invention taken transverse to the plane of the longitudinal section of FIG. 3, showing the tie rod and buffer spring assembly.

Refering to the drawings and particularly FIGS. 1, 2, 3, 4 and 9 which illustrate both the exterior and interior configuration of the present paving breaker, a paving breaker 10 is illustrated that generally includes a backhead assembly 12, a fronthead assembly 13, a cylinder assembly 14 extending between the fronthead and backhead assemblies 12 and 13 and a generally rectangular plastic cover 16 clamped between the fronthead assembly 13 and the cylinder assembly 14 by two tie rods (FIG. 4).

A valve assembly 18 is mounted in backhead assembly 12 and reverses the flow of compressed air to the opposite ends of the cylinder assembly 14 to cause reciprocation of a free piston 20 slidably mounted within the cylinder assembly 14. Piston 20 moves from an upper or rear position under the force of compressed air from valve assembly 18 downwardly or forwardly to the position illustrated in FIGS. 3 and 4 where it impacts on a tappet or plunger 22 which in turn impacts upper end of a moil point or steel 23, driving steel 23 outwardly into the work aggregate to be broken up.

Air is admitted to the valve assembly 18 through an inlet fitting 24 in the backhead and a lever operated throttle valve 25 and through passage 26. "T" handles 28 and 29 project from and are carried by the backhead 12 and a throttle valve operating lever 30 extends over handle 29 to permit operation of the throttle valve 25 while the worker's hands remain on both handles.

The backhead assembly 12 includes a main steel casting 32 that is insert molded into a thick polyurethane cover 33 that has a rectangular cover portion 35 that extends forwardly over the upper end of the cylinder assembly 14. Cover portion 35 has an internal recess 36 for receiving the rear end of the cover 16. The polyurethane cover 33 surrounding the backhead member 32 provides not only a durable cover for the steel portion of the backhead but also eliminates any fasteners between the cover portion 35 and the backhead member 32.

Inlet fitting 24 is threadedlyly received by an integral side boss 38 on backhead member 32 and is adapted to receive a conventional connector on the end of a compressor hose line. The throttle valve 25 includes a valve stem 40 having a guide portion 41, slidably mounted in a bore 42 in backhead member 32, connected to a throttling land 44 by a reduced stem portion 45. A reduced head 7 projects from valve stem 40 and carries a plastic valve seal 48 having a frusto-conical sealing surface 49 engaging a complementary seat 50 in the backhead member 32. A tapered coil compression spring 52 reacts against a recessed surface in the inlet fitting 24 at one end and against valve seal 48 at its other end urging the valve seal and valve to a closed position shown in FIG. 3 blocking flow from inlet fitting 24 to valve assembly 18. Valve guide portion 41 has a rounded end 52 that projects within a recessed area 53 of the backhead member 32 and is engaged by a camming surface 54 on throttle lever 30. As the throttle lever 30 is pivoted about pivot 55, valve guide portion 41 is depressed against the biasing force of spring 52 opening valve seal 48 and throttling land 44 to permit air under pressure to flow through passage 26 to the valve assembly 18.

Handle 29 includes a sleeve member 57 pivottally mounted at 58 on handlebar 59. The pivotal movement of sleeve 57 permits the operator to throttle flow through valve 25 during tool withdrawal by partly releasing the throttle lever 30. This can be seen more clearly in FIG. 14 wherein the upper pivotal movement of the handle sleeve 57 from the position shown in the drawing will raise the throttling land 44 to a throttling position adjacent valve seat 50 to reduce the flow of air to the valve 18 during tool withdrawal so that the moil point continues to vibrate but at a reduced rate to assist the withdrawal of the tool steel from the aggregate.

Figure 5:
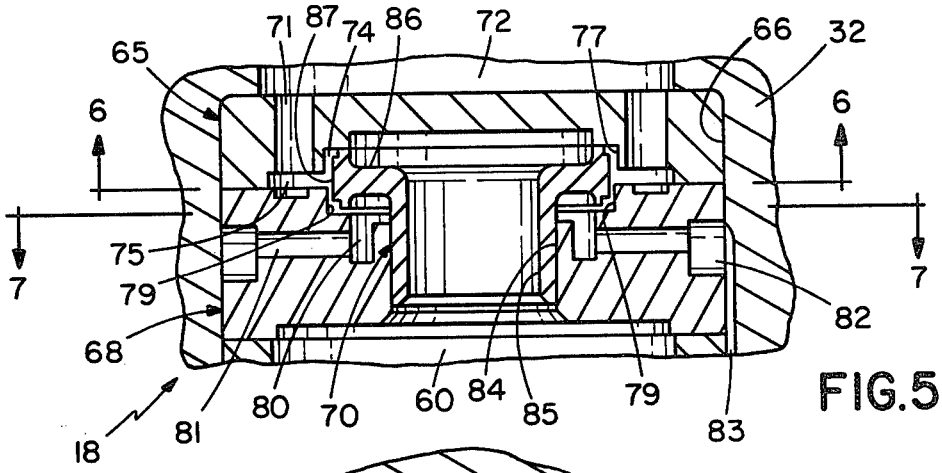
FIG. 5 is an enlarged fragmentary section of a reversing valve and block assembly illustrated in full lines at the top or rear end of the cylinder in FIGS. 3 and 4.
Figure 6:
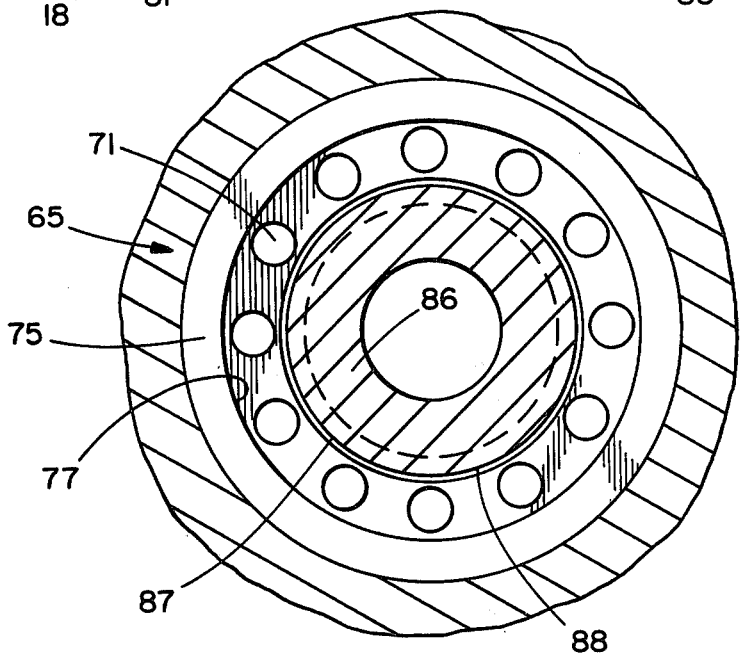
FIG. 6 is a cross-section of an upper valve block taken generally along line 6—6 of FIG. 5.
Figure 7:
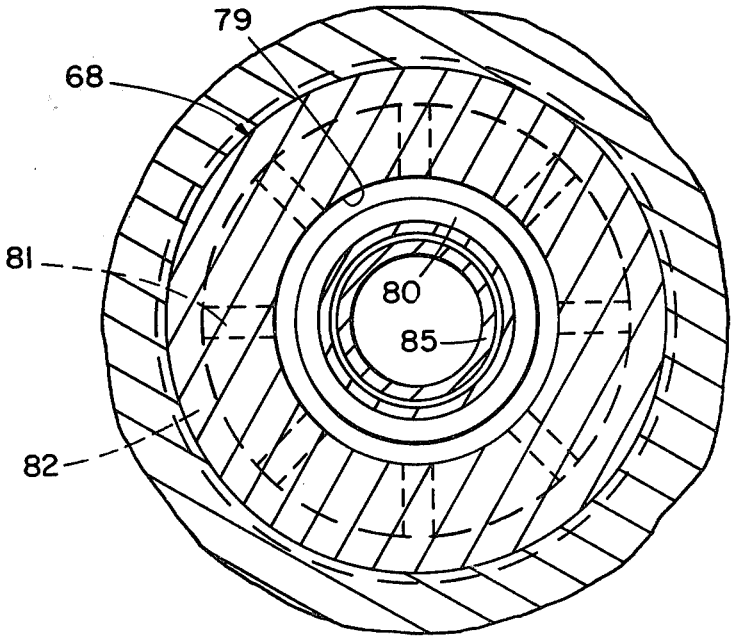
FIG. 7 is a cross-section of a lower valve block taken generally along line 7—7 of FIG. 5.

As seen more clearly in FIGS. 3, 4, 5 and 8 valve assembly 18 is provided for alternately directing compressed air from inlet valve 25 to cylinder assembly power chamber 60 during the forward stroke of piston 20 and to return chamber 61 for the return stroke of piston 20. Valve assembly 18 ports fluid to chamber 60 through the center of the assembly as seen in FIG. 5 and ports fluid to cylinder return ports 63 seen in FIG. 3 through a return passage 64 between cylinder assembly inner sleeve 65 and outer sleeve 66.

Figure 8:
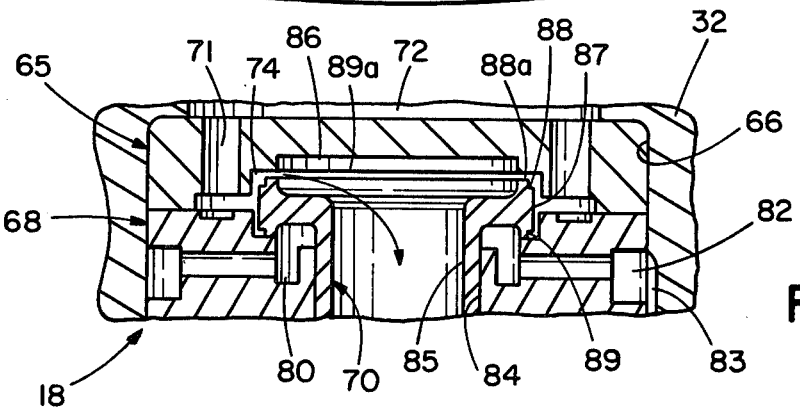
FIG. 8 is a fragmentary section of the reversing valve and valve block assembly similar to that illustrated in FIG. 5 but with the valve in its lower power stroke position.

Viewing FIGS. 5 and 8, the valve assembly 18 includes an annular upper valve block member 65 seated in a counterbore 66 in backhead member 32, a mating annular lower valve block member 68 also seated in counterbore 66, and an axially reciprocable self guided reversing valve member 70. The upper valve block member 65 has an annular array of axial ports 71 communicating with a chamber 72 in backhead member 32 that receives fluid under pressure from throttling valve outlet passage 26 as seen in FIG. 3. Upper valve block passages 71 communicate with an annular chamber 74 surrounding valve member 70 through a chamber 75 formed by counterbore in the mating surface of the upper valve block member 65. Chamber 74 is defined by a counterbore 77 in the upper valve block member 65 and a counterbore 79 in the face of the lower valve block member 68. Counterbore 77 has a larger diameter than counterbore 79 to provide increased flow to the cylinder chamber 60 during the power stroke when the valve 70 is in its lower position illustrated in FIG. 8.

The lower valve block member 68 has an annular recess 80 that receives compressed air from around valve member 70 when the valve is in its upper position illustrated in FIG. 5, which is the return stroke position of the valve. Compressed air in annular recess 80 flows through a plurality of radially extending passages 81 to an annular peripheral recess 82 around lower valve block member 68. Flow into passage 68 travels through an axial recess 83 in backhead counterbore 66 (See FIG. 3), then between the inner cylinder sleeve 65 and the outer cylinder sleeve 66 to return passage 64 and into the return ports 63 at the forward end of the cylinder assembly 14.

The valve member 17 is a one piece self guided lightweight valve that reciprocates at speeds up to 1600 cycles per minute with an axial travel of about 0.030 inch. Valve member 70 includes an annular reduced guide stem portion 85 slidable, in a closely fitting bore 84 centrally positioned in lower valve block member 68 that also serves as a seal between the pressure in power chamber 60 and return chamber 61 in the cylinder assembly. The small diameter of valve guide portion 85 decreases the overall weight of the valve and increases its ability to cycle rapidly which is required in the present paving breaker.

Formed integrally with the reduced guide portion 85 on valve 70, is an enlarged radially directed annular flange portion 86 extending into valve block chamber 74, that has an outer metering land 87 that meters flow across the land in both positions of the valve illustrated in FIGS. 5 and 8. Metering land 87 cooperates with upper valve block counterbore 77 to meter flow to the power chamber 60 when the valve member is in its lower position illustrated in FIG. 8 and meters flow with counterbore 79 in the lower valve block member 68 when the valve is in its upper position illustrated in FIG. 5 delivering fluid to forward cylinder chamber 61.

Right angle expansion grooves 88 and 89 are positioned on opposite sides of the metering land 87 and provide areas within the valve block chamber 74 for fluid to expand after passing the metering of land 87 to improve flow to the cylinder in both positions of the valve member. Grooves 88 and 89 may be simply turned on a lathe without requiring any special finishing or grinding. The short axial length of the enlarged portion of the valve member including flange 86 and land 87 significantly contributes to the reduced weight of the valve member 70 and thereby its increased speed and response.

The expansion grooves 88 and 89 form sealing ribs 88*a* and 89*a* on the top and bottom of valve portion 86 that seat and seal against the bottom of counterbore 77 and counterbore 79 respectively.

Valve 70 shifts upwardly to the FIG. 5 position when pressure in recess 79 (forward chamber pressure) exceeds pressure on top of the valve (rear chamber pressure), and shifts downwardly when the pressure differential reverses.

The cylinder assembly 14 has its inner sleeve 65 reduced at its upper end 90 and fitted within counterbore 66 in backhead member 32 as shown clearly in FIGS. 3 and 4. The lower end of inner cylinder sleeve 65 is pressed onto a reduced boss portion 91 on a tappet bushing 92 that slidably receives tappet member 22. An upper annular seal 92 is provided in an enlarged counterbore 93 formed around backhead counterbore 66 at the upper end of the cylinder assembly 14. The inner surface of seal 92 is spaced from the outer surface from the inner sleeve 65 so that return air flowing through backhead passage 83 may freely pass between the inner and outer sleeves 65 and 66 to the return passage 64. The outer sleeve 66 engages and is sealed on seal 92 but is freely slidable axially with respect to the seal.

An annular elastomeric sleeve 94 surrounds and is bonded to the inner cylinder sleeve 65 and has two spaced cutout portions defining the return passage 64. Cylinder outer sleeve 66 is bonded to the elastomeric sleeve 94 and is free at its lower end 96 so that it may reciprocate a limited distance with respect to sleeve 65 due to the inherent resiliency of the elastomeric sleeve 94. The outer sleeve 66 reciprocates with respect to the inner sleeve 65 in out of phase relation with the piston 20 to balance the reactionforces caused by the piston on the breaker as it reciprocates within the cylinder assembly 14. Toward this end the sleeve 66 has a weight approximating that of the piston 20 e.g. 4.5 pounds each, and the elastomeric sleeve 94 has a durometer in the range of 80 to 90 Shore A. Elastomeric sleeve 94 may be a rubber material such as "Viton" or may be polyurethane. By the proper selection of the thickness and durometer of the elastomeric material 94 along with the relative weights of the sleeve 66 and the piston 20, within the ranges previously indicated, the sleeve 66 can be made to reciprocate 180 degrees out of phase with the piston 20 to achieve its maximum balancing effect to reduce vibration within the tool normally caused by the acceleration and deceleration of the piston.

Figure 10:
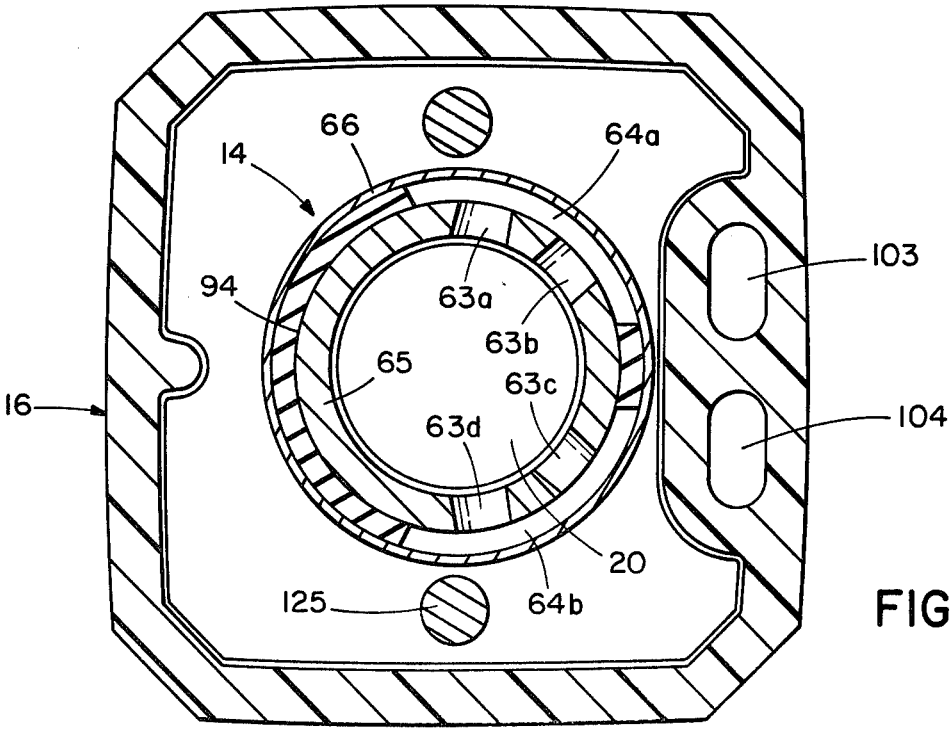
FIG. 10 is an enlarged cross-section taken generally along line 10—10 of FIG. 3 illustrating the cylinder return ports.

As seen in FIG. 10, which is a cross-section taken along the line of 10—10 of FIG. 3 through the return ports in the cylinder 14, return ports 63A, 63B, 63C, and 63D are seen to be radial bores through the right side of the inner cylinder sleeve 65 that communicate with return passages 64A and 64B between the inner and outer sleeves, 65 to 66 defined by voids in the elastomeric material 94.

Return passages 64A and 64B each have an arcuate length of about 90 degrees and extend axially from just below the return ports 63 to the rear (top) of the sleeve 94.

Figure 11:
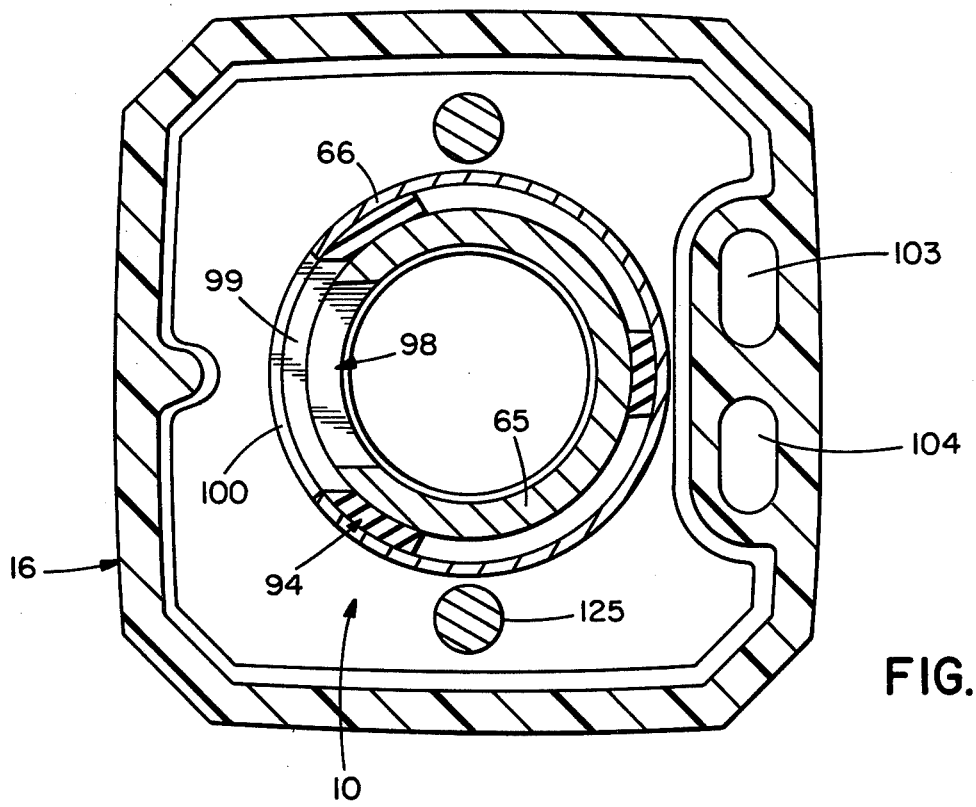
FIG. 11 is an enlarged cross-section taken generally along line 11—11 of FIG. 3 illustrating the cylinder exhaust ports.

As seen in FIG. 11 which is a cross-section taken along line 11—11 of FIG. 3 illustrating the cylinder exhaust port, a radial slot 98 is formed in cylinder inner sleeve 65 just forwardly of the midpoint of the cylinder which communicates through a slot 99 in the elastomeric material 94 and a mating slot 100 in outer sleeve 66 with an open annular area 102 surrounding the cylinder assembly 14 within the cover 16.

Figure 9:
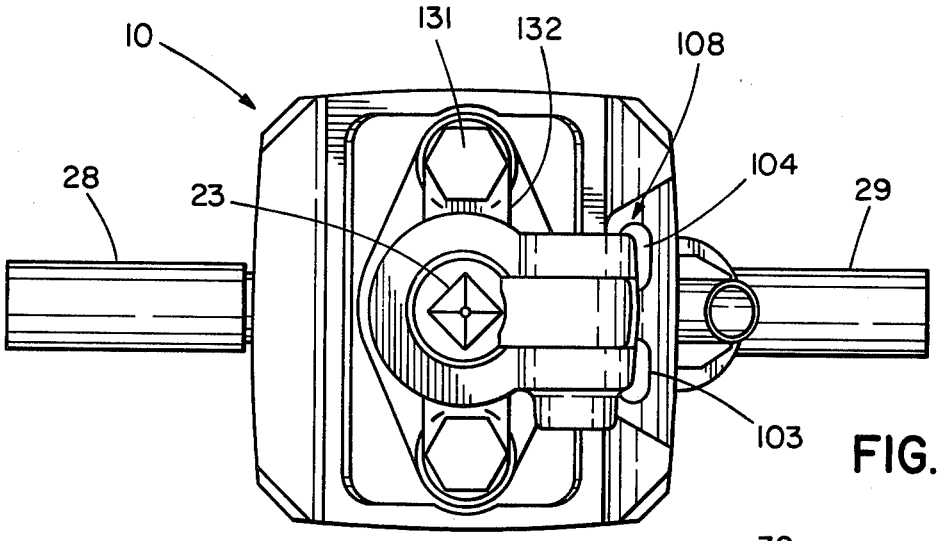
FIG. 9 is a bottom view of the paving breaker according to the present invention looking at the moil point tip.

Exhaust flow from the exhaust port 98 passes around the cylinder assembly 14 to assist in cooling the cylinder assembly passes rearwardly or upwardly around the cylinder and out exhaust passages 103 and 104 formed intergrally in the cover member 16 as seen clearly in FIGS. 3 and 11. Exhaust passages 103 and 104 open at 106 near the lower end of the cover member 16 as seen in FIGS. 3 and 9.

As seen in FIGS. 3 and 4, the tappet bushing 92 has a through bore having a reduced diameter portion 108 that slidably receives a cylindrical guide portion 109 on tappet 22, and an enlarged diameter portion 110 axially aligned therewith that slidably receives an intergral head portion 112 on the tappet defining on impact head for intermittently striking tool steel end 113 as seen in FIG. 3. The spaced guide surfaces defined by the bore portions 109 and 110 in the bushing 92 precisely align the tappet 22 for linear movement parallel and coincident with the axis of cylinder assembly 14. Thus, any misalignment of the tool steel 23 at the instant of impact with the tappet 22 will not create any side forces on the piston 20 thereby eliminating unnecessary wear on the walls of the inner cylinder sleeve 65.

The fronthead 13 illustrated at the forward and lower end of the tool 10 is generally annular in configuration and has enlarged upper portion 115 that is pressed over a lower boss 116 on tappet bushing 92. The lower end of the forward head 13 has a pivotally mounted retainer 116 having an offset projection 117 that provides a stop for limiting outward movement of the tool steel by engagement with a stop flange 118 on the steel.

The polyurethane cover 16 that surrounds the cylinder assembly 14 has an internal flange 120 as seen in FIGS. 3 and 4 that is clamped between the upper end of the fronthead portion 115 and the lower or forward end of the inner cylinder sleeve 65. The outer cylinder sleeve 66 is permitted to easily pass over the outer periphery of inner flange 120.

Figure 12:
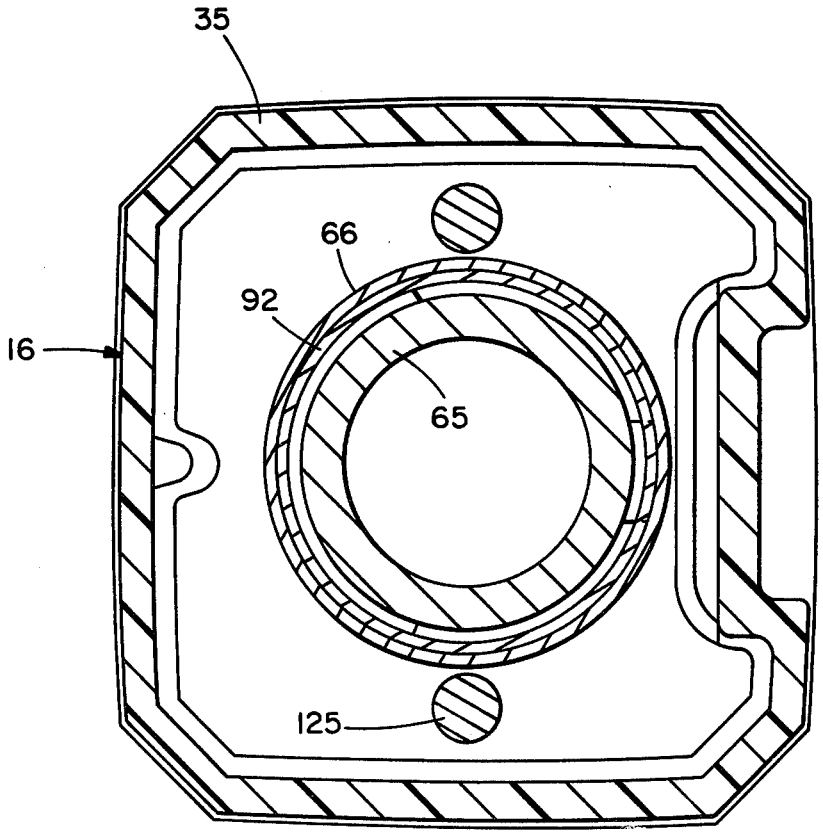
FIG. 12 is an enlarged cross-section taken generally along line 12—12 of FIG. 3 illustrating the rear end of the return passages between the cylinder sleeves.

The polyurethane cover 16 is urged upwardly into the backhead cover 35 and against cylinder sleeve 65 by a pair of tie rods 122 and 123 that have heads 124 seated in the backhead with rod portions 125 extending through the space 102 between the cover 16 and the cylinder assembly 14 (See FIGS. 10, 11 and 12), through aperatures 127 in cover flange 120, and through bores 128 in side flanges 129 formed integrally with the upper fronthead portion 115. Suitable fasteners 131 and a spring retainer 132 react through buffer springs 134 to clamp the polyurethane cover 16 between the backhead assembly 12 and the front head assembly 13 and at the same time seat cover flange 120 upwardly against the end of the inner cylinder sleeve 65.

Figure 13:
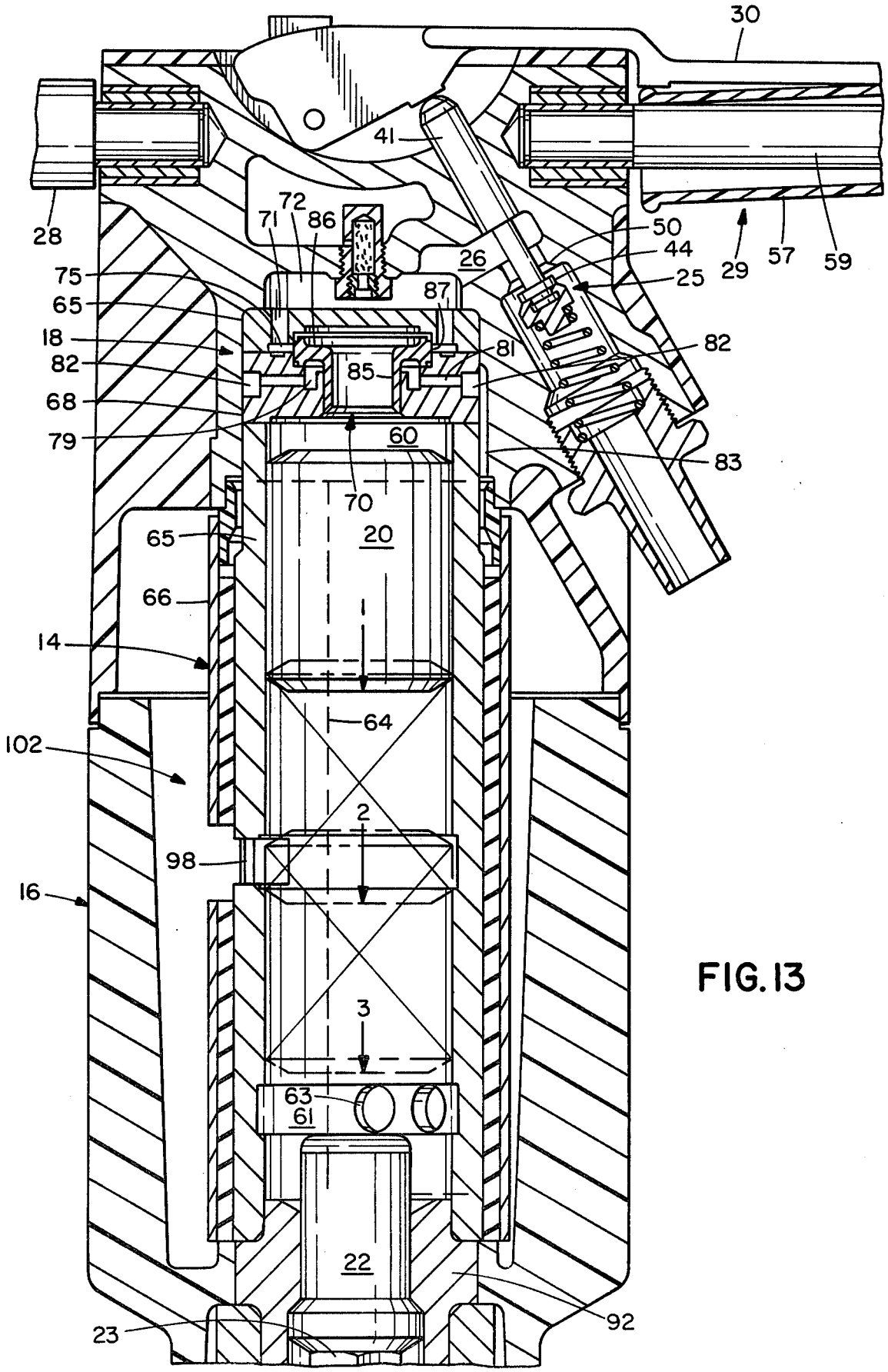
FIG. 13 is an enlarged fragmentary longitudinal section of the paving breaker illustrated in FIG. 2 with the piston moving in its forward or power stroke.
Figure 14:
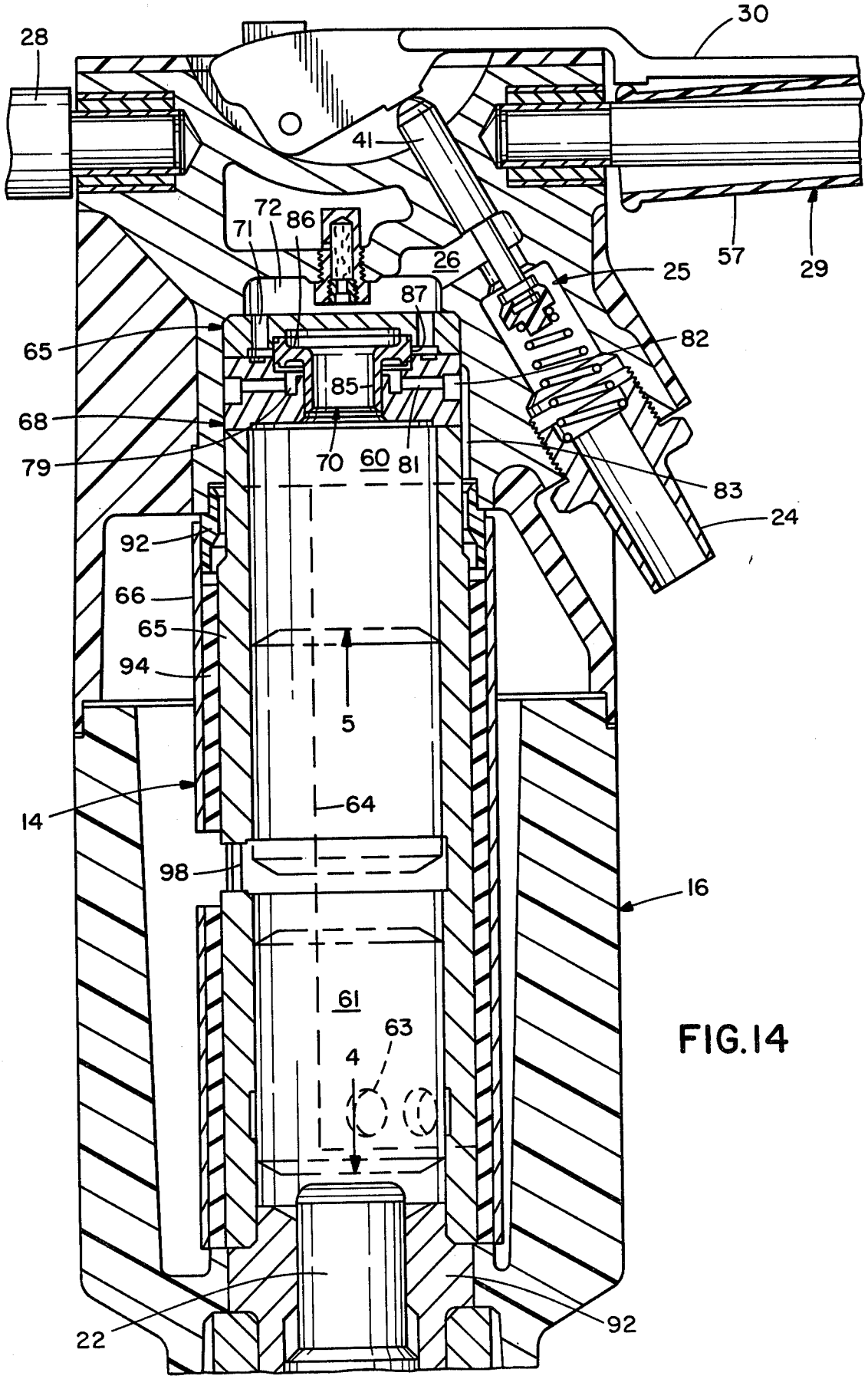
FIG. 14 is a fragmentary longitudinal section similar to FIG. 13 illustrating piston impact with the tool steel tappet and partial piston return.
Figure 15:
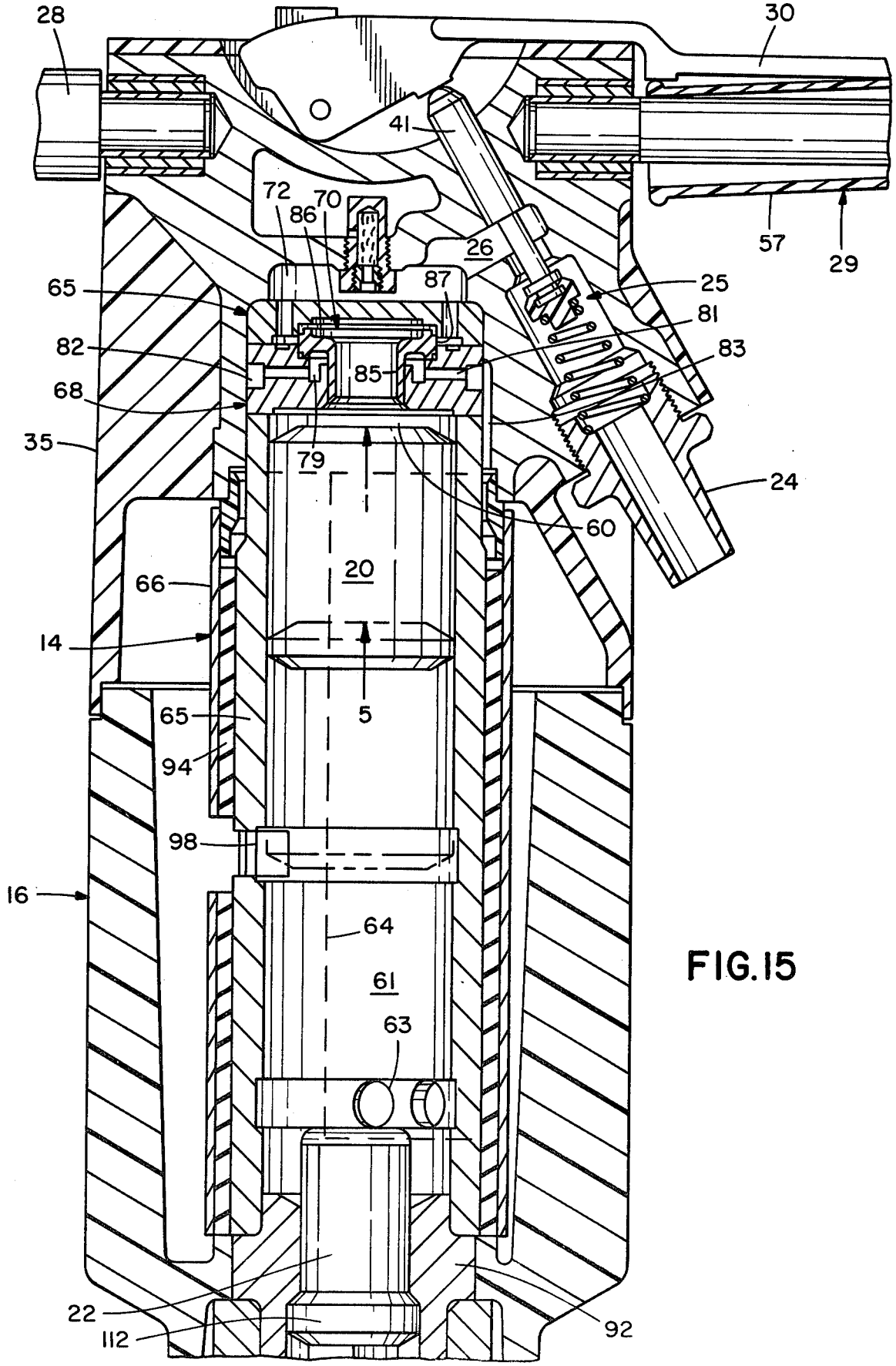
FIG. 15 is a fragmentary longitudinal section similar to FIG. 14 illustrating completion of piston return stroke.

Referring to FIGS. 13, 14 and 15 for a description of the operation of the paving breaker illustrated in FIGS. 1 to 12, it should be understood that the arrows indicate the leading edge of the piston 20 and point in the direction of its motion. Firstly, referring to FIG. 13 with the piston in position 1 at the rear of the cylinder assembly 14, the operator depresses the throttle lever 30 as shown, opening throttle valve 25 admitting air into valve assembly 18. Valve member 70 will then move to its lower position shown seated in the lower valve block 68 due to differential pressure acting on the valve member. With the piston in position 1, the lower valve block chamber 79 is exhausted to atmosphere through passages 81, 82, 83 return passage 64 and exhaust port 98. Compressed air in the upper valve block chamber 75 escaping around the sides of the metering land 87 forces the valve member 70 downwardly. Flow will then pass over the top of the enlarged valve flange 86 through the center of the valve guide 85 into the power chamber 60 driving the piston 20 downwardly.

As the piston travels downwardly from position 1 shown in FIG. 13 it drives air in the forward cylinder chamber 61 out exhaust port 98 until it reaches a position illustrated in FIG. 13 where it seals the exhaust port 98. Further travel of the piston 20 downwardly from position 2 compresses air in the forward chamber as well as the return passage 64 between the inner and outer cylinder sleeve 65 and 66. The two arcuate return passages 64 define an accumulator for air being compressed during this portion of the stroke of the piston 20, to reduce the increase in pressure in the forward end of the cylinder so that the piston is not overly decelerated prior to its impact with the tappet 22. At the same time the return passage 64 should not be so large that it consumes an excessive quantity of air since they are exhausted after the piston passes upwardly in its return stroke.

As the piston moves downwardly from position 2 illustrated in FIG. 13 compressing air in the foward cylinder chamber 61 it reaches a position, designated position 3 where the rear end of the piston uncovers the exhaust port 98, exhausting air in rear cylinder chamber 60 rapidly dropping pressure on the top side of valve 70 causing the valve to move rapidly upwardly to its position illustrated in FIG. 14 as the accumulated pressure increases in the return passage 64.

With the valve member 70 in its upper position illustrated in FIG. 14, the top of the valve member is sealed in upper valve block counterbore 77 and inlet air passes downwardly over metering land 87 into the lower valve block passage 79, radial passages 82, annular passage 82, downwardly through passage 83 in backhead member 32, inside sealing ring 92, around the outer periphery of inner cylinder 65, into and downwardly through the return passage 64, into return ports 63 and into the forward cylinder chamber 61.

The forward inertia of the piston carry it downwardly from position 3 illustrated in FIG. 13 (as valve member 70 moves upwardly) to just above its FIG. 14 position and where it strikes tappet 22 forcing the tappet to impact against the tool steel 23 driving the steel into the work. As the pressure in the forward chamber 61 continues to rise (with valve member 70 in its upper position illustrated in FIG. 4), the piston 20 will be arrested as a bottom or forward dead center position illustrated approximately in position 4 in FIG. 14, and the piston will immediately reverse itself and begin upward travel exhausting air in the rear or upper cylinder chamber through exhaust port 98 until it reaches a position (not shown in FIG. 14) where it closes exhaust port 98 and begins compressing air in the rear cylinder chamber 60. The piston continues traveling rearwardly (upwardly) from this position to a position near position 5 illustrated in FIG. 14 where the rear end of the piston uncovers exhaust port 98 permitting the forward chamber 61 to be exhausted. This causes a rapid decrease in pressure on the lower side of valve member 70 and with the increase in pressure on the top side of valve member 70 caused by compression in rear chamber 60, valve member 70 drops to its lower position sealed in the lower valve block member 68 illustrated in FIG. 15. This causes inlet fluid to be directed again over the top of valve member 70 between metering land 87 and upper valve block counterbore 77, through the center of valve 70 into rear cylinder chamber 60. The resulting buildup of pressure in chamber 60 arrests the upward or rearward movement of piston 20 approximately in position 1 illustrated in FIGS. 13, 15, and reverses the piston direction and then the next cycle begins.

It should be understood that each cycle of operation i.e., each complete power and return stroke of piston 20, occurs on the order of 1600 cycles per minute.

In higher powered paving breakers the buffer spring 34 illustrated in FIG. 4 are provided and act as a shock absorber when the piston 20 hits the tappet 22 or even the tappet bushing 92 when there is no load on the tool 23. In effect buffer springs 34 permit the forward head 13 with its projections 129 to separate slightly from the remaining parts of the tool under these no load impacts.

In FIGS. 16 to 19 a somewhat modified form of the present invention is illustrated. In this embodiment a backhead assembly 148, a throttle valve assembly 150, a valve assembly 151, a backhead cover 152, a polyurethane cover 153, a tappet bushing 154, a tappet 155 and a forward head 157 are provided all identical in construction and operation to the corresponding parts in the FIGS. 1 to 15 embodiment so that a detailed description is not believed necessary.

In this embodiment a cylinder assembly 160 is provided that is similar to the dual sleeve cylinder illustrated in FIGS. 1 to 15 embodiment except that no piston balancing is provided and the cylinder assembly 160 is totally fixed within the backhead 148.

Toward this end the cylinder assembly 160 includes an inner sleeve 161 pressed within a counterbore 163 in the backhead that also seats the valve assembly 151. The lower end of the inner sleeve is fitted over a central boss 164 on the tappet bushing 154 in a manner similar to the FIGS. 1 to 15 embodiment inner sleeve 65.

An outer cylinder sleeve 166 surrounds the inner sleeve 161 and is mounted directly on annular surfaces on the inner sleeve 161 and is seated and sealed at its upper or rear end in a counterbore 168 in the backhead assembly and its lower end 169 engages cover flange 171 so that the outer sleeve 166 is prevented from reciprocating with respect to the other parts of the tool.

The space between the sleeves 161 and 166 form return passages for delivering fluid under pressure to return ports 173 in the forward cylinder chamber 177 in the same way as in the embodiment of FIGS. 1 to 15.

Figure 17:
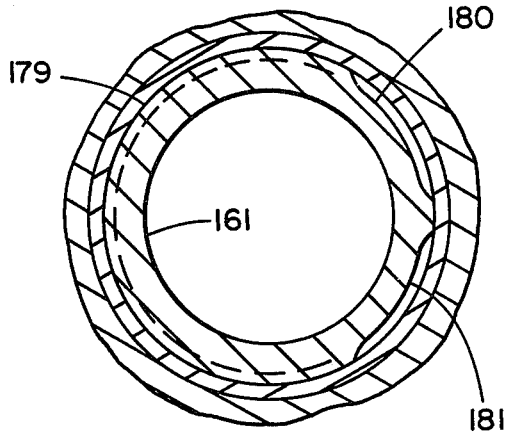
FIG. 17 is a fragmentary cross-section taken generally along line 17—17 of FIG. 16 illustrating the rear or upper portion of the return passages.

As seen in FIG. 17, the inner sleeve has an upper peripheral flange 179 that provides an annular mounting surface for the upper end of the outer sleeve 166. Flange 179 has spaced recesses 180 and 181 extending axially therethrough that define passages through which return air flowing in backhead passage 182 may pass into the space between sleeves 161 and 166 defining a return passage 183.

Figure 18:
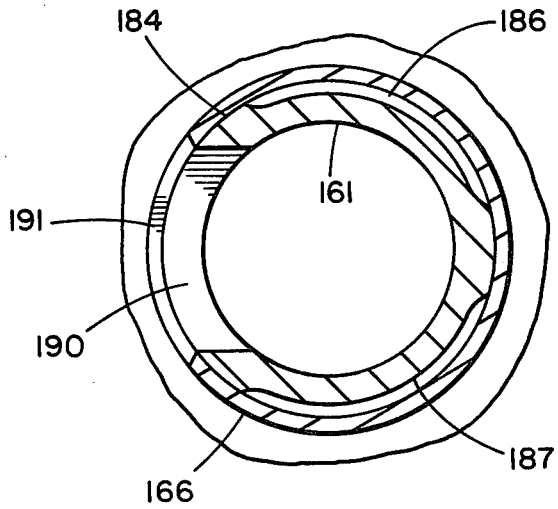
FIG. 18 is a fragmentary cross-section taken generally along line 18—18 of FIG. 16 illustrating the cylinder exhaust ports.

A second annular flange 184 is provided on the periphery of the inner sleeve 161 somewhat forward of midstroke in the cylinder assembly 160, and as seen in FIG. 18 flange 184 has recesses 186 and 187 therein that define passages for the flow of return of air in the return air passage 183.

Figure 16:
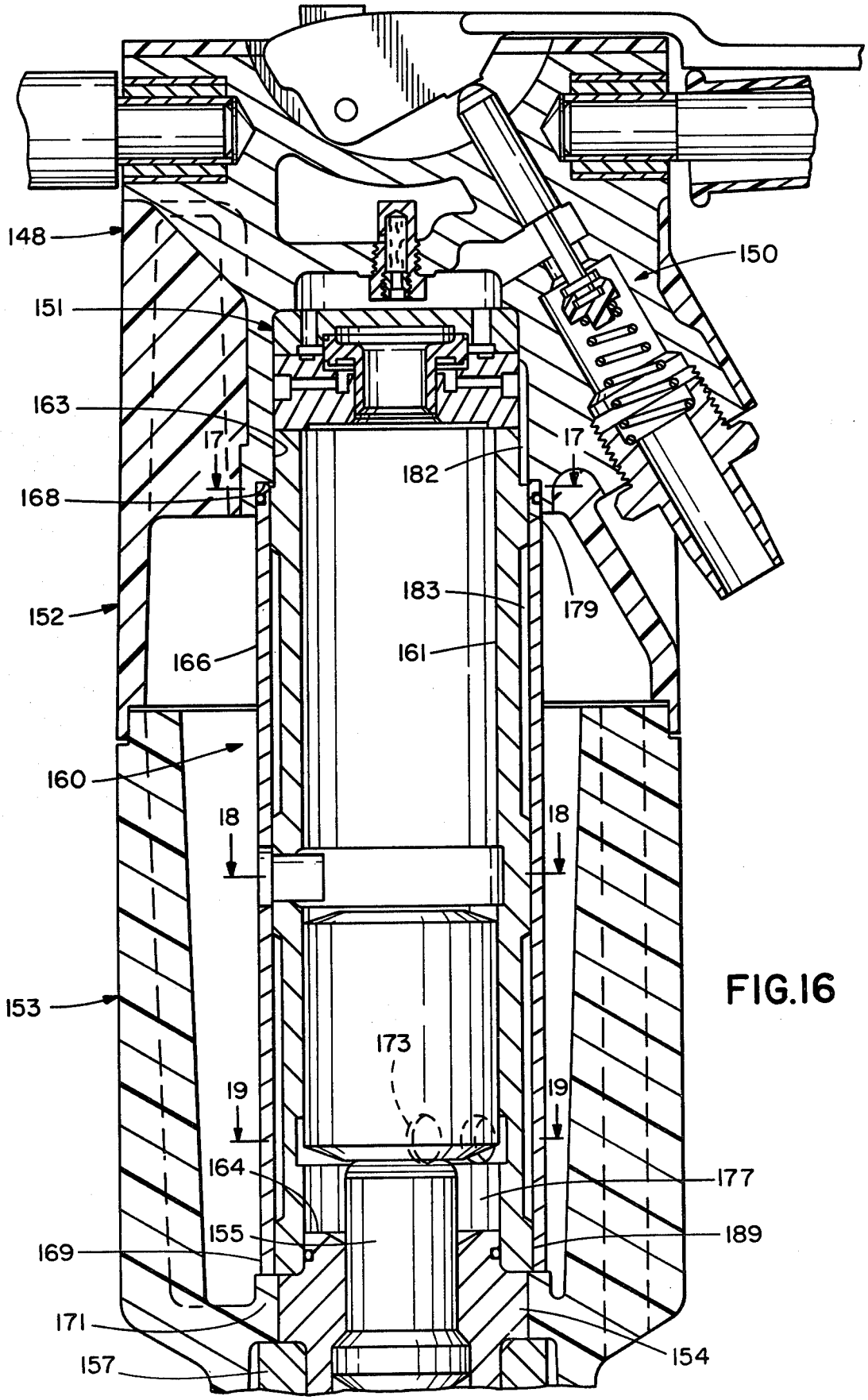
FIG. 16 is a fragmentary longitudinal section of a paving breaker according to another embodiment of the present invention.
Figure 19:
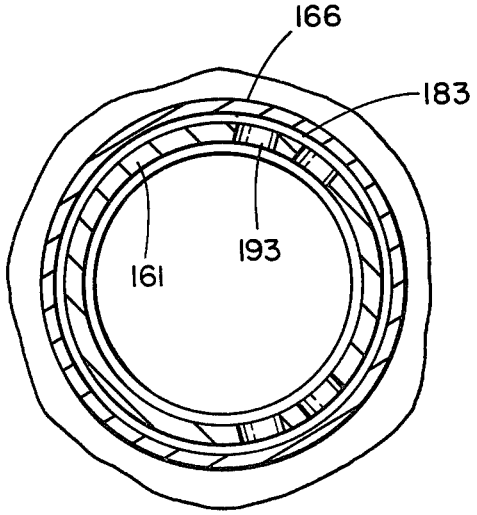
FIG. 19 is a fragmentary cross-section taken generally along line 19—19 of FIG. 16 illustrating the cylinder return ports.

As seen in FIG. 16 a third peripheral flange 189 is provided on the periphery of the inner sleeve 161 at the lower end thereof for engaging and supporting the outer sleeve 166, but flange 189 has no passages therethrough and forms a complete seal with the outer sleeve 166. As seen in FIG. 19, the inner sleeve 161 has a plurality of return ports 193 formed therein that communicate the forward cylinder chamber with annular return passage 183 between the inner and outer sleeves 161 and 166.

As seen in FIG. 18, an exhaust slot 190 is provided in the inner sleeve 161 that extends through flange 184 and connects with a complementary slot 191 in the outer sleeve 166 permitting exhaust air to flow from the cylinder chambers.

The paving breaker illustrated in FIGS. 16 to 19 operates in the same manner as described above with respect to the FIGS. 1 to 15 embodiment except the outer cylinder sleeve 166 is rigidly mounted within the tool and does not affect piston balance.

What is claimed is:

1. A paving breaker, comprising; housing means, cylinder means in the housing means reciprocably receiving a free piston, a tool slidably mounted in the housing means positioned to be impacted as the piston reciprocates in the cylinder means, valve means in the housing means for alternately porting fluid under pressure to opposite sides of the cylinder means to drive the piston in reciprocation, said cylinder means including an annular inner sleeve slidably receiving the piston and an outer sleeve spaced from the inner sleeve to define an axial passage therebetween, port means at one end of the inner sleeve communicating with the axial passage between the inner and outer sleeves, said valve means being connected to port fluid under pressure through the axial passage and the inner sleeve port means into the cylinder means to drive the piston in one direction, second port means adjacent the other end of the inner sleeve, said valve means being connected to port fluid under pressure to the second port means alternatly with the first port means to drive the piston in the other direction in the cylinder means, and exhaust port means positioned between the first port means and the second port means, said exhaust port means including a port in the inner sleeve controlled by the piston so that as the piston passes over the exhaust port fluid in front of the piston is compressed and fluid behind the piston is exhausted, said inner sleeve having an upper annular outer flange with passages therethrough supporting one end of the outer sleeve, said inner sleeve also having an enlarged outer central portion with passages therethrough supporting the outer sleeve, said inner sleeve having an enlarged outer lower portion without passages therethrough supporting the outer sleeve.

2. A paving breaker, comprising; housing means, cylinder means in the housing means reciprocably receiving a free piston, a tool slidably mounted in the housing means positioned to be impacted as the piston reciprocates in the cylinder means, valve means in the housing means for alternately porting fluid under pressure to opposite sides of the cylinder means to drive the piston in reciprocation, said cylinder means including an annular inner sleeve slidably receiving the piston and an outer sleeve spaced from the inner sleeve to define an axial passage therebetween, port means at one end of the inner sleeve communicating with the axial passage between the inner and outer sleeves, said valve means being connected to port fluid under pressure through the axial passage and the inner sleeve port means into the cylinder means to drive the piston in one direction, and an elastomeric material between the outer and inner sleeves to at least partly balance the forces produced by acceleration and deceleration of the piston as it reciprocates in the cylinder means, said outer sleeve being supported only on the elastomeric material so that it is free to reciprocate axially with respect to the housing means and the inner sleeve.

3. A paving breaker as defined in claim 2, wherein the elastomeric material has a durometer selected with respect to the inertia of the piston and the inertia of the outer sleeve so that the outer sleeve reciprocates axially approximately 180 degrees out of phase with respect to the piston to substantially balance the forces of the piston and the outer sleeve acting on a housing means.

4. A fluid operated paving breaker comprising; housing means, cylinder means having a free piston slidably mounted therein, a tool slidably mounted in the housing means adapted to be impacted as the piston reciprocates, valve means for alternately delivering fluid to opposite ends of the cylinder means to reciprocate the piston therein, said cylinder means including an inner metal sleeve slidably receiving and engaging the piston, an outer sleeve surrounding the inner sleeve and defining a passageway therebetween for conveying fluid from the valve means to the interior of the inner sleeve, and a resilient means mounting the outer sleeve in the housing means for limited reciprocating movement with respect to the inner sleeve in response to the reaction forces produced by the piston to at least partly balance the forces produced by the piston on the housing means.

5. A fluid operated paving breaker comprising; housing means, cylinder means in the housing means having a free piston slidably mounted therein, a tool slidably mounted in the housing means adapted to be impacted as the piston reciprocates, valve means in the housing means for alternately delivering fluid under pressure to opposite sides of the cylinder means to reciprocate the piston therein, said cylinder means including an inner sleeve slidably receiving and engaging the piston, an outer sleeve surrounding the inner sleeve and defining a passageway therebetween for conveying fluid from the valve means to the interior of the inner sleeve, said outer sleeve being axially movable with respect to the inner sleeve, and an elastomeric sleeve connecting the outer and inner sleeves for reducing noise produced by the paving breaker.

6. A fluid operated paving breaker comprising; housing means, cylinder means in the housing means having a free piston slidably mounted therein, a tool slidably mounted in the housing means adapted to be impacted as the piston reciprocates, valve means in the housing means for alternately delivering fluid to opposite sides of the cylinder means to reciprocate the piston therein, said cylinder means including an inner metal sleeve slidably receiving and engaging the piston, an outer sleeve surrounding the inner sleeve, and a resilient means mounting the outer sleeve in the housing means for limited reciprocating movement in response to the reaction forces produced by the piston to at least partly balance the forces produced by the piston on the housing means, said resilient means mounting the outer sleeve including an elastomeric material between and bonded to the outer and inner sleeves, said elastomeric material having a durometer in the range of 80 to 90 Shore A so that the outer through the axial passage and the inner sleeve port means into the cylinder means to drive the piston in one direction, and an elastomeric material between the outer and inner sleeves to at least partly balance the forces produced by acceleration and deceleration of the piston as it reciprocates in the cylinder means, said outer sleeve being supported only on the elastomeric material so that it is free to reciprocate axially with respect to the housing means and the inner sleeve.

7. A fluid operated paving breaker as defined in claim 6, wherein the elastomeric material has an axial passage therein communicating with the valve means, port means in the inner sleeve at one end thereof communicating with the axial passage in the elastomeric material so that the valve means conveys fluid under pressure to one side of the cylinder means through the axial passage in the elastomeric material, and said axial passage being sufficiently large so that it may act as an accumulator for fluid compressed by the piston as it travels towards said one end of the inner sleeve.

8. A fluid operated paving breaker, comprising; housing means, cylinder means in the housing means slidably, receiving a piston, a tool slidably mounted at one end of the cylinder means adapted to be impacted as the piston reciprocates, valve means for porting fluid to opposite ends of the cylinder means to reciprocate the piston, said valve means including a valve member reciprocably mounted in the housing means movable between a first position porting fluid to the cylinder means to drive the piston from a first position to a second position, and a second position porting fluid to the cylinder means to drive the piston from its second position to its first position, said valve member having an enlarged metering land controlling fluid flow to the cylinder in both the first and second positions thereof, said valve member having an intergral reduced portion slidably mounted in an opening in the housing means to guide movement of the valve member, said cylinder means including an inner sleeve slidably receiving the piston, an outer sleeve surrounding the inner sleeve, and a resilient sleeve mounting the outer sleeve in the housing means for limited reciprocating movement in response to the reaction forces produced by the piston to at least partly balance the forces produced by the piston on the housing means.

* * * * *